United States Patent [19]

Larsen

[11] Patent Number: 4,761,841

[45] Date of Patent: Aug. 9, 1988

[54] HOSPITAL GURNEY HAVING A PATIENT TRANSFER DEVICE

[76] Inventor: Ralph E. Larsen, Box 35, Osceola, Mo. 64776

[21] Appl. No.: 48,568

[22] Filed: May 11, 1987

[51] Int. Cl.[4] ..... A61G 7/08

[52] U.S. Cl. ..... 5/81 R; 5/81 B

[58] Field of Search ..... 5/81 B, 86, 81 C, 81 R; 297/248; 312/335, 341 R, 345

[56] References Cited

U.S. PATENT DOCUMENTS

| | | | |
|---|---|---|---|
| 1,829,274 | 10/1931 | Gilroy . | |
| 2,450,971 | 10/1948 | Letch . | |
| 2,528,048 | 10/1950 | Gilleland . | |
| 2,665,432 | 1/1954 | Butler . | |
| 2,691,782 | 10/1954 | West . | |
| 2,733,452 | 2/1956 | Tanney . | |
| 2,918,681 | 12/1959 | Davis . | |
| 3,493,979 | 2/1970 | Koll et al. . | |
| 3,579,672 | 5/1971 | Koll et al. . | |
| 3,593,351 | 7/1971 | Dove . | |
| 3,786,523 | 1/1974 | Sele . | |
| 3,967,328 | 7/1976 | Cox . | |
| 4,044,073 | 3/1978 | Koll . | |
| 4,073,016 | 2/1978 | Koll . | |
| 4,087,873 | 5/1978 | Ohkawa | 5/81 B |
| 4,137,581 | 2/1979 | Daly . | |
| 4,259,756 | 4/1981 | Pace . | |
| 4,631,761 | 12/1986 | Lederman | 5/81 R |
| 4,669,137 | 6/1987 | Schnelle | 5/81 C X |
| 4,688,278 | 8/1987 | Aspert | 5/81 B |
| 4,718,133 | 1/1988 | DiMatteo | 5/81 B X |
| 4,726,082 | 2/1988 | DiMatteo | 5/81 B X |

FOREIGN PATENT DOCUMENTS

| | | | |
|---|---|---|---|
| 2544839 | 4/1976 | Fed. Rep. of Germany | 5/81 R |

*Primary Examiner*—J. Franklin Foss

*Attorney, Agent, or Firm*—Hovey, Williams, Timmons & Collins

[57] ABSTRACT

A hospital gurney is provided which allows a single attendant to conveniently and safely transfer a patient between a hospital bed, examination table, or the like and the gurney while minimizing patient discomfort. The preferred structure includes a rollable gurney frame, a laterally shiftable patient conveyor, means coupling the patient conveyor with the gurney frame for lateral outward shifting of the conveyor relative thereto, and a laterally extendable plate coupled with the gurney frame below the level of the conveyor. In use, the gurney is placed next to a hospital bed, for example, the plate is extended outwardly to rest upon the bed surface, and the conveyor is shifted laterally outwardly onto the plate for supportive engagement therewith; the belting material included as part of the patient conveyor freely moves to allow one attendant to transfer the patient between the bed and the gurney.

8 Claims, 2 Drawing Sheets

HOSPITAL GURNEY HAVING A PATIENT TRANSFER DEVICE

BACKGROUND OF THE INVENTION

1. Field of the Invention

The present invention relates to hospital gurneys used for transporting patients about in a hospital and for transferring patients between the gurney and a hospital bed, examination table, or the like. More particularly, the above invention relates to a rollable hospital gurney including a laterally outwardly shiftable patient conveyor coupled thereto, and a laterally outwardly shiftable support plate coupled below the conveyor for resting on the surface of the hospital bed or the like and for supporting the conveyor when extended laterally outwardly from the gurney.

2. Description of the Prior Art

Effective treatment of non-ambulatory hospital patients often requires that the patient be transported within the hospital from place to place at various times. For example, a patient may need to be transported between an operating table and a hospital bed, examination table, and or the like. Patients are usually transported between these various locations using a conventional fixed-bed rollable hospital gurney. To use such a gurney, it is typically necessary for at least two and as may as six or more attendants to bodily lift or slide or in some cases roll the patient between the gurney and the hospital bed, for example.

This kind of manhandling of non-ambulatory patients is typically uncomfortable for the patient and may even be determental to the patient's condition depending upon the nature of the patient's injury or illness. Furthermore, the additional labor required makes patient transfer a labor intensive process and may cause delays while a sufficient number of attendants are coordinated to lift a patient between the hospital gurney and the hospital bed, for example.

The prior art discloses various hospital gurney improvement devices intended to minimize patient discomfort and labor requirements. For example, U.S. Pat. No. 3,493,979 discloses a hospital gurney having a rectangular endless conveyor belt coupled with and laterally extendable from the gurney in which the conveyor belt is cantilevered over a hospital bed. The cantilevered conveyor belt is supported by a mechanically complex coupling arrangement including telescoping guide rails.

Another example of the prior art includes U.S. Pat. No. 1,829,274 which illustrates a gurney equipped with a rigid table surface or apron which is transversely slidable relative to the upper frame of the gurney in which the apron can be extended over a hospital bed. In use, attendants must slide the patient along the apron when transferring to or from the gurney.

As illustrated by the above discussion, the known devices in the prior art disclose complex mechanical structures which are only partially effective in minimizing patient discomfort and labor requirements when transferring a patient to and from a hospital gurney. Accordingly, the prior art reveals a need for a hospital gurney which is mechanically simple with which one attendant can conveniently and safely transfer a patient to and from the gurney.

SUMMARY OF THE INVENTION

The problems outlined above are solved by the hospital gurney in accordance with the present invention. That is to say, the hospital gurney hereof presents a relatively mechanically simple structure which allows one attendant to safely and conveniently transfer a hospital patient with minimal patient discomfort.

Broadly speaking, the hospital gurney hereof includes a rollable support frame; a patient conveyor including a support structure and conveyor material presenting a patient-support surface shiftably coupled with the structure for lateral shifting movement relative thereto; means shiftably coupling the conveyor with the frame for lateral, outward shifting of the conveyor relative to the frame; and conveyor support means for supporting the conveyor when it is shifted laterally outwardly from the frame.

Preferably, the conveyor support means includes a laterally shiftable plate which is designed to extend over a hospital bed or the like and to engage the top surface of a hospital bed thereby providing a smooth, firm support surface for the conveyor when also extended over the bed, and for supporting the entire hospital gurney to prevent toppling when a patient is being transfered to or from the gurney.

Advantageously, the conveyor support structure includes a plurality of elongated pulleys and means rotatably coupling the pulleys in a parallel, spaced-apart relationship around which the conveyor material is configured as an endless belt for transverse movement relative to the pulleys. Additionally, the extendable plate includes means for limiting its outward travel to about half of its width. Advantageously, the conveyor coupling means includes a belt lock for releasably preventing movement of the belt relative to the support structure, and a conveyor lock for releasably preventing shifting of the conveyor relative to the frame.

BRIEF DESCRIPTION OF THE DRAWINGS

FIG. 4 is a partial sectional view along line 4—4 of FIG. 3;

DESCRIPTION OF THE PREFERRED EMBODIMENT

Figures 1, 3, 8, 9:
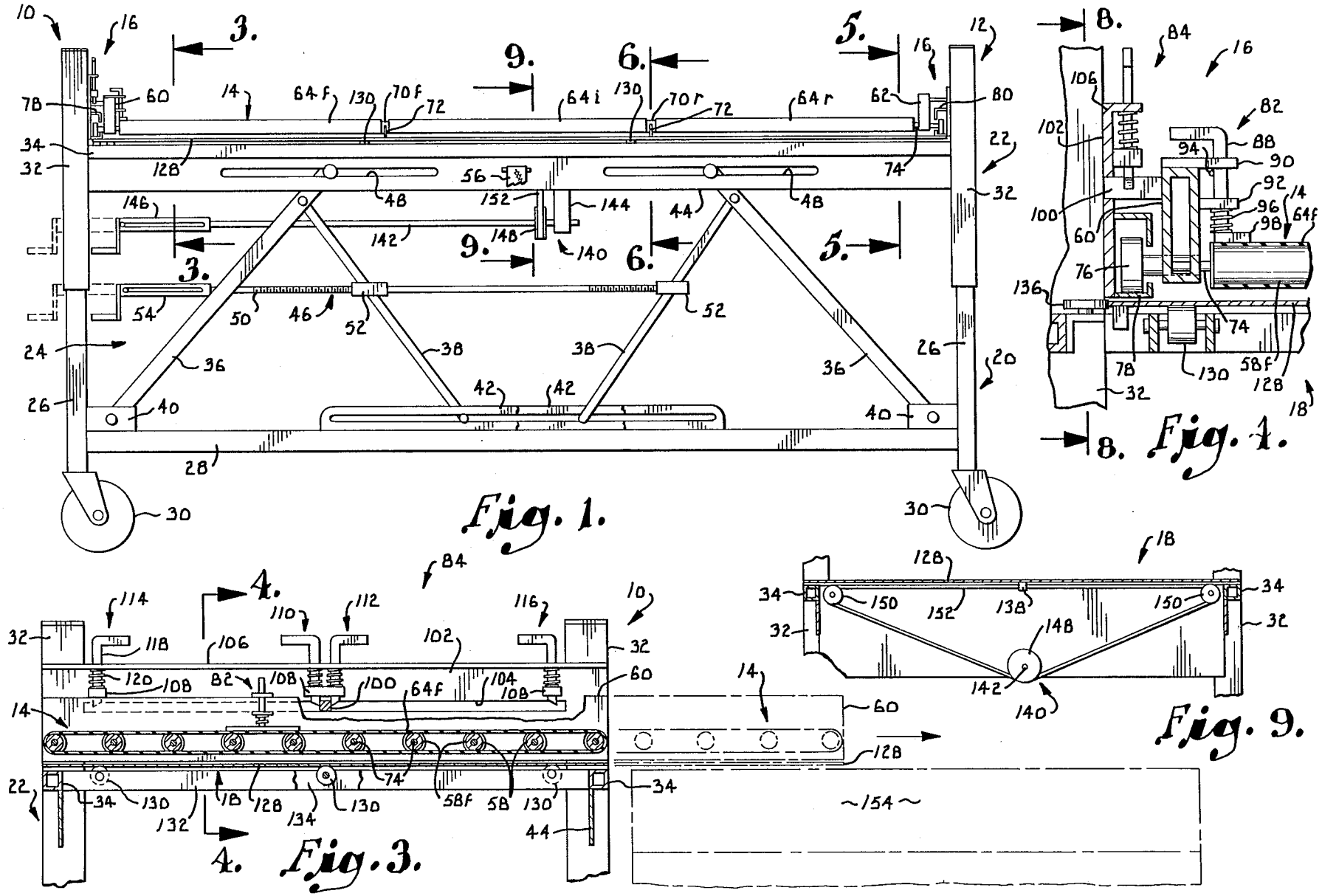
FIG. 1 is a side elevational view of the hospital gurney.
FIG. 3 is a partial sectional view along line 3—3 of FIG. 1.
FIG. 8 is a partial sectional view along line 8—8 of FIG. 4 showing in phantom lines the plate and conveyor track wheel in the extended position.
FIG. 9 is a view along line 9—9 of FIG. 1.
Figure 6:
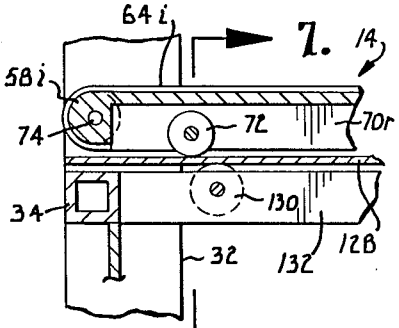
FIG. 6 is a partial sectional view along line 6—6 of FIG. 1.

Referring now to the drawing figures, hospital gurney 10 broadly includes support frame 12, patient conveyor 14, conveyor coupling assembly 16, and plate structure 18.

Support frame 12 is conventionally configured and includes lower framework 20, upper framework 22, and scissor lift mechanism 24.

Lower framework 20 includes four vertical, lower, support posts 26 interconnected in a spaced-apart relationship near the lower ends thereof by four lower tubular members 28 (only one of which is shown in FIG. 1), and four caster-type transport wheels 30 respectively coupled with the lower ends of lower posts 26. Advantageously, a conventional foot-operated wheel lock structure (not shown) may be included with gurney 10 for selectively locking wheels 30 to prevent inadvertant movement of gurney 10.

Upper framework 22 includes four, tubular vertical, upper posts configured to slidably receive respective lower support posts 26 therein to permit vertical adjustment of upper framework 22 relative to lower framework 20. Additionally, upper framework 22 includes four, upper, horizontal tubular support members 34 for rigidly maintaining upper post 32 in their vertical, spaced-apart relationship.

Conventional scissor lift 24 intercouples lower and upper frameworks 20, 22 for selective vertical adjustment of upper framework 22 relative to lower framework 20. Scissor lift 24 includes a first pair of corresponding, slidable, support members 36, a second pair of corresponding, slidable, support members 38, a pair of corresponding, pivot supports 40, a respective pair of guide tracks 42, an elongated scissor slide plate 44 intercoupling two upper support posts 32 as shown in FIG. 1, and scissor crank mechanism 46. Pivot supports 40 are preferably welded to post 26 and member 28 where they form respective inside corners. The lower ends of first slidable members 36 are respectively pivotally coupled to pivot supports 40. The upper ends of members 36 are slidably and respectively received within a pair of spaced-apart, elongated, horizontal, guide slots 48 longitudinally defined in scissor plate 44.

The upper ends of second slidable members 38 are pivotally coupled with members 36 near the upper ends there as shown in FIG. 1. The lower ends of second slidable members 38 are slidably received in respective guide tracks 42 arranged one behind the other as viewed in FIG. 1.

Scissor crank mechanism 46 includes an elongated, cylindrical, threaded rod 50 which is threadably received in respective apertured scissor blocks 50 respectively coupled to second slidable members 38 at about the midway point as shown in FIG. 1. A telescoping crank handle 54 is slidably coupled to the forward end of crank rod 50. As conventionally used, handle 54 can be extended outwardly from the forward end of gurney 10 whereby an attendant can rotate handle 54 in one direction to extend upper framework 22 vertically upwardly with respect to lower framework 20 and in the opposite direction to lower upper framework 22.

Upper framework 22 advantageously includes a conventional safety belt 56 which can be conveniently coupled to scissor plate 44 as illustrated in FIG. 1. Those skilled in the art will recognize that gurney 10 can be equivalently equipped with conventional, adjustable side rails also for preventing a patient from inadvertently falling from gurney 10.

The preferred patient conveyor 14 includes ten cylindrical pulleys 58; forward and rearward, tubular support headers 60 and 62 presenting a rectangular cross-section; forward, intermediate, and rearward belting material section 64*f*, 64*i*, and 64*r*; forward and rearward, transverse intermediate support channels 70*f* and 70*r*, and six conveyor support rollers 72.

Figure 2:
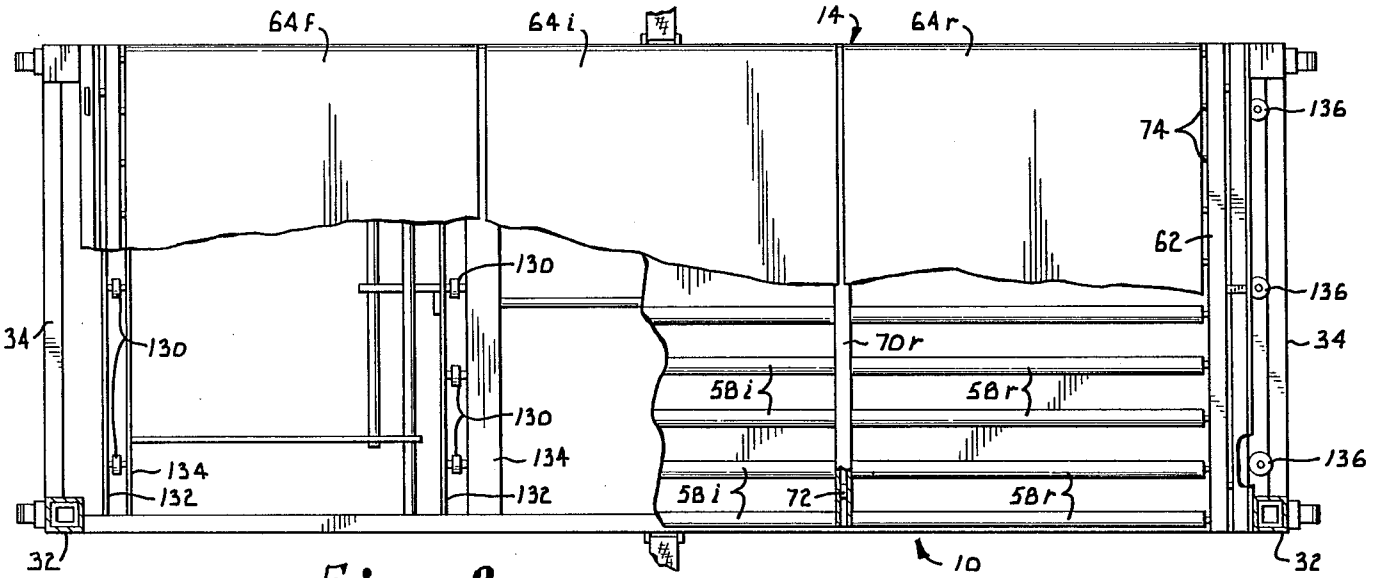
FIG. 2 is a top view of the hospital gurney with sections cut away to illustrate features of the gurney.

Each pulley 58 includes an elongated axle 74 and forward, intermediate, and rearward, spaced-apart pulley sections 58*f*, 58*i*, and 58*r* fixed coaxially to axle 74. Respective ends of axle 74 are rotatably coupled with headers 60 and 62 which maintain pulleys 58 in a parallel, spaced-apart relationship as illustrated in FIGS. 2 and 3. Each axle 74 rotatably extends through support channels 70*f*, *r*. Each pulley 58 is configured to present pulley section 58*f* between forward header 60 and first support channel 70*f*, intermediate pulley section 58*i* between support channels 70*f* and *r*, and rearward pulley section 58*r* between rearward support channel 70*r* and rearward header 62 as illustrated in FIGS. 1 and 2.

Preferably, pulleys 58 are constructed of stainless steel with axle 74 being about one-quarter inch in diameter and with each pulley section 58*a–c* being one-inch in diameter.

Each belting material section is preferably configured as an endless belt with section 64*f* surrounding pulley sections 58*f*, intermediate belting material section 64*i* surrounding intermediate pulley sections 58*i*, and rearward belting material sections 64*r* surrounding rearward pulley sections 58*r*. Belting sections 64*f,i,r* are preferably composed of washable synthetic resin material.

Figure 7:
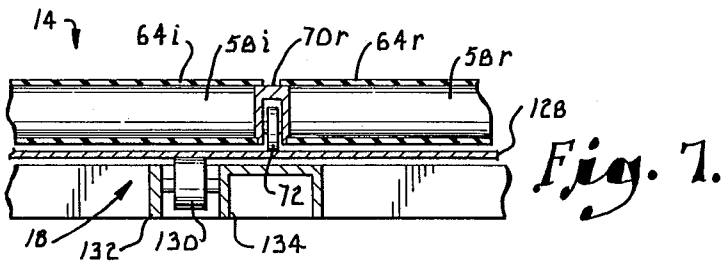
FIG. 7 is a partial sectional view along line 7—7 of FIG. 6.
Figure 8:
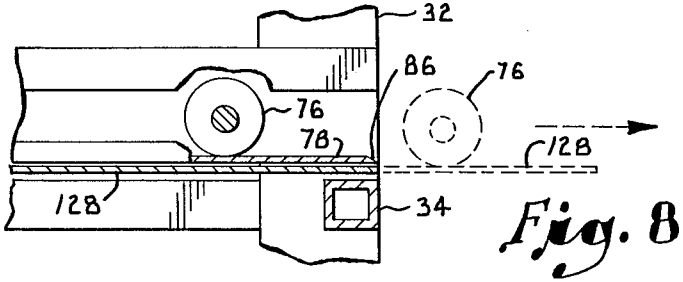

Each support channel 70*f,r* open downwardly as shown in FIG. 7, and includes three support rollers 72 rotatably coupled between the downwardly extending legs. Rollers 72 are spaced-apart with one intermediate along the length of each channel 70*f,r* and with one each adjacent opposed ends thereof and extend slightly below channels 70*f,r* to provide intermediate support for conveyor 14.

Conveyor coupling assembly 16 couples conveyor 14 with upper framework 22 so that conveyor 14 can be extended laterally outwardly from either side of gurney 10 as illustrated in phantom lines in FIG. 3.

Conveyor coupling assembly 16 includes six rotable conveyor track wheels 76—three of which extend outwardly from forward support header 60, and three of which extend outwardly from rearward support header 62. Additionally, assembly 16 includes forward wheel track 78, rearward wheel track 80, belt lock 82, and conveyor lock assembly 84.

Figure 5:
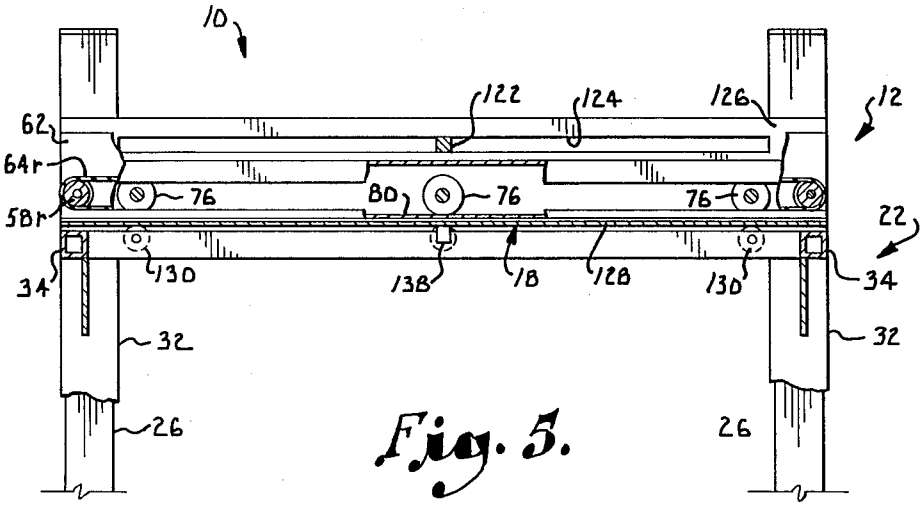
FIG. 5 is a partial sectional view along line 5—5 of FIG. 1.

The three track support wheels 76 of each set are spaced apart as shown in FIG. 5, and the sets are received within respective forward and rearward wheel tracks 78, 80.

Wheel tracks 78, 80 each present a C-shaped configuration as shown in FIG. 4 and present a beveled edge 86 (FIG. 8) at each end so that wheels 76 make a smooth transition when exiting tracks 78, 80 from either end as will be explained further hereinbelow.

Belt lock 82 includes L-shaped rod 88 coupled as shown in FIG. 4 to forward support header 60 by apertured support members 90, 92 which are configured to slidably receive one leg of rod 88 vertically therethrough, locking nib 94 coupled with the vertical leg of rod 88, retaining spring 94, and locking shoe 98. Spring 96 engages the lower face of support member 22 and the upper surface of locking shoe 98 to bias locking shoe 98 downwardly into engagement with forward belting material section 64*f* which also thereby prevents rotation of pulleys 58 and belting sections 64*i* and *r*. To release lock 82, the attendant grasps the horizontal leg of rod 88 and pulls upwardly until nib 94 moves through a corresponding slot (not shown) in support member 90 so that locking nib 94 is disposed above the top face of support member 90. The attendant then rotates rod 88 and releases it whereby locking nib 94, having been displaced from the slot defined in support member 90, engages the top surface thereof and prevents rod 88 from returning to the locked position. To return lock 82 to the locked position, the attendant rotates rod 88 to align nib 94 with the slot in support member 90 whereupon the bias of spring 96 moves rod 88 downwardly into the locked position.

Conveyor lock assembly 84 (FIGS. 3 and 4) is designed to releasably lock conveyor 14 in one of three positions—centered, extended left, or extended right. Assembly 84 includes a horizontally disposed, forwardly extending, locking stud 100 affixed to the outboard surface of forward support header 60 above the level of forward wheel track 78; locking assembly plate 102 disposed between and affixed to the forward pair of upper posts 32; an elongated, horizontally disposed, locking guide slot 104 extending the entire length of plate 102 between respective posts 32; apertured support angle 106; three apertured support members 108; a pair of inboard locking units 110 and 112; and a pair of outboard locking units 114 and 116.

The outboard, forward end of stud 100 extends through slot 104 which arrangement thereby limits the lateral travel of conveyor 14 at the respective ends of slot 104.

Each locking unit 110–116 includes an L-shaped rod 118 one leg of which is vertically disposed and received through corresponding axially aligned apertures in support angle 106 and support members 108, and biasing spring 120 disposed between the lower face of support angle 106 and a projection (not shown) fixed to the vertical leg of rod 118. Spring 120 biases rod 118 downwardly. The lower end of each vertical leg of rod 118 is beveled at an angle as shown in FIG. 3.

Inboard locking units 110, 112 are spaced apart at a distance equal to the width of stud 100 to hold stud 100 between the lower ends of rod 118 as shown in FIG. 3 with the angled portion of each facing away from stud 100. Outboard locking units 114, 116 are disposed near opposed ends of slot 104.

Rearward support header 62 also supports a guide stud 122 which is received in a corresponding guide slot 124 defined in rearward guide plate 126. Stud 122, however, has no associated locking units in the preferred embodiment.

Plate structure 18 includes plate 128, and means for supporting plate 128 including: a plurality of plate support rollers 130 rotatably coupled between two respective sets of plate roller support members 132, 134 affixed transversely to upper framework 22 between side members 34, and a plurality of plate guide rollers 136 rotatably coupled with forward and rearward members 34 about a vertical rotational axis to engage opposed ends of plate 128.

Plate 128 is preferably composed of one-eighth inch stainless steel plate and is slightly longer than patient conveyor 14. Plate support rollers 138 support and locate plate 128 just below conveyor 14 as shown in FIGS. 7 and 3 so that conveyor support rollers 72 engage the upper surface of plate 128. Plate rollers 130 also support plate 128 so it is laterally outwardly extendable from either side of gurney 10. Guide rollers 136 engage opposed ends of plate 128 to prevent longitudinal shifting thereof (FIG. 4).

Plate 138 also includes a downwardly projecting plate stop member 138 centrally disposed along the center line thereof which prevents plate 128 from extending outwardly more than about half of its width. That is to say, plate stop 128 comes into abutting engagement with respective upper support members 34 when extended to the outboard limit of its travel.

Additionally, plate structure 18 includes plate extension device 138 for extending plate 140 laterally outwardly from either side of gurney 10. Plate extension device 140 includes a horizontally disposed drive shaft 142 coupled to a pair of bearing blocks 144 (only one of which is shown) affixed to upper framework 22. The forward end of shaft 142 includes a telescoping handle 146 (FIG. 1). Plate extension device 140 also includes a V-belt drive sheave 148 connected to drive shaft 142, a pair of driven sheaves 150, and V-belt 152 coupled about sheaves 148–150 and also coupled to plate 128 as shown in FIG. 9.

In the use of gurney 10 to transfer a hospital patient therefrom to a hospital bed 154, for example, gurney 10 is first placed closely alongside hospital bed 154. The attendant extends plate crank handle 146 forwardly and rotates it in order to extend plate 128 laterally outwardly over bed 154 to its fully extended position as limited by plate stop 138 (FIG. 3). The attendant then extends scissor lift handle 54 and rotates handle 54 in order to lower upper framework 22 until the lower surface of plate 128 firmly engages the top surface of bed 154. In this position, plate 128 functions as an outrigger so that as a patient is being transferred from bed 154 to gurney 10, plate 128 prevents gurney 10 from toppling.

The attendant then lifts the horizontal leg of L-shaped rod 118 of inboard locking unit 112 with one hand in order to release stud 100 and thus conveyor 14 to shift rightwardly as viewed in FIG. 3. Conveyor 14 can then be shifted rightwardly onto plate 128 until stud 100 shifts to the rightmost position of slot 104 and abuts the end wall thereof. As stud 100 nears the end of slot 104, it engages the lower angled portion of rod 118 which pushes rod 118 upwardly against the bias of spring 120 until stud 100 abuts plate 102 at the rightmost end of slot 104. At this point, spring 120 returns rod 118 to its downwardly extending position thereby locking stud 100 and thus conveyor 14 in the rightwardly extended position. Upon viewing FIG. 3, it is readily apparent that locking unit 110 and 114 function in an analogous manner when conveyor 14 is moved leftwardly.

As conveyor 14 shifts rightwardly, the rightmost pair of conveyor track wheels 16 coupled to opposed ends of conveyor 14, also move outwardly onto plate 128 (FIG. 8). The beveled edges 86 of tracks 78 and 80 enable a smooth transition of the rightmost conveyor track wheels 76 onto plate 128. Note that when conveyor 14 is in the rightmost position, the center and leftmost conveyor track wheels 76 on respective ends of conveyor 14 remain engaged with tracks 78, 80. That is to say, in the rightwardly extended position, the rightmost conveyor track wheels 76 rest on plate 128 while the centermost and leftwardmost pairs of respective track wheels 76 remain engaged and supported by respective tracks 78, 80. In this way, conveyor 14 remains firmly supported by gurney 10 by means of plate 128 and the centermost and leftmost pairs of track wheels 76 which remain engaged with their respective tracks 78, 80.

After conveyor 14 is extended to its rightmost position and locked in place by outboard locking unit 116, the attendant then lifts rod 88 of belt lock 82 upwardly and turns it so that locking nib 94 holds shoe 98 above belt 64. With belt lock 82 thus in the unlocked position, belts 64–68 are free to move about pulleys 58. The attendant can then gently shift the patient from conveyor 14 onto bed 154 with minimal patient discomfort.

After the patient is transferred to bed 154, the attendant then locks belt lock 82, releases outboard conveyor lock 116, recenters conveyor 14 on gurney 10, and then raises uper frame work 22 so that plate 128 is no longer in contact with bed 154. Plate 128 is then returned to its centered position within upper framework 22. The aboved recited steps are reversed to transfer a patient from a hospital bed, examination table, or the like onto gurney 10 for transport to another hospital location. As the above discussion illustrates, the invention hereof enables one attendant to safely and conveniently transfer a patient to and from preferred gurney 10 with minimal patient discomfort. Condition and size of the patient dictates whether one or two attendants are needed. For example, if the patient is unconscious, unable to move, or is very large, two attendants may be needed.

Those skilled in the art will appreciate that the present invention contemplates many variations in the preferred embodiment herein described. For example, pulleys 58 could be replaced by a low friction slider plate which would eliminate the need for separate pulley sections **58*c* and the intermediate conveyor support wheels 72. The arrangement with pulleys 58 is preferred, however, to ensure easy shifting of belt section 64–68**.

Having thus described the preferred embodiment of the present invention, what is claimed as new and desired to be secure by Letters Patent is:

1. A gurney for transporting a hospital patient resting thereon and for safely and conveniently transferring the patient between said gurney and a hospital bed, examination table, or the like said gurney comprising:

a rollable support frame including means for rolling supportive engagement with a floor surface;

a patient conveyor including a support structure and conveyor material presenting a patient-support surface shiftably coupled with said structure for lateral shifting movement relative thereto;

means shiftably coupling said conveyor with said frame for lateral, outward shifting of said conveyor relative to said frame, said conveyor presenting an outwardly extended portion when shifted laterally outwardly from said frame; and conveyor support means for supporting said extended portion when said conveyor shifted laterally outwardly from said frame, said conveyor support means including:

a conveyor support plate, and means shiftably coupling said plate with said frame below said conveyor for lateral, outward shifting of said plate relative to said frame, said plate presenting an outwardly extended section when shifted laterally outwardly relative to said frame, said outwardly extended conveyor portion including means for rolling supportive engagement with said plate section when said conveyor and said plate are extended laterally outwardly from said frame.

2. The gurney as set forth in claim 1, said conveyor coupling means including structure for shifting said conveyor laterally outwardly from either side of said frame.

3. The gurney as set forth in claim 1, said support structure including a plurality of elongated pulleys and means rotatably coupling said pulleys in a parallel, spaced-part relationship, said conveyor material being configured as an endless belt coupled about said structure for transverse movement relative to said pulleys, the upper surface of said belt presenting said patient support surface, said said support surface being supported by said pulleys.

4. The gurney as set forth in claim 3, said conveyor coupling means including belt lock means for releasably preventing movement of said belt relative to said support structure, and including conveyor lock means for releasably preventing shifting of said conveyor relative to said frame.

5. The gurney as set forth in claim 3, said gurney further including at least one intermediate conveyor support surface, said conveyor including at least one intermediate support structure for rolling supportive engagement with said conveyor support surface.

6. The gurney as set forth in claim 1, said plate coupling means including structure for shifting said plate laterally outwardly from either side of said frame.

7. The gurney as set forth in claim 1, said conveyor support means including means for limiting lateral, outward shifting of said plate to about one-half the width of said plate.

8. The gurney as set forth in claim 1, said conveyor support means including means for supportively engaging the top surface of a hospital bed, examination table, or the like adjacent said gurney for preventing toppling of said gurney while the patient is transferred between said gurney and the hospital bed, examination table, or the like.

* * * * *